US005399842A

United States Patent [19]

Watanabe et al.

[11] Patent Number: 5,399,842

[45] Date of Patent: Mar. 21, 1995

[54] COMPOSITE MATERIAL FOR MICROWAVE HEATING

[75] Inventors: Hideo Watanabe; Katsumasa Sagarifuji, both of Mishima; Akira Mitoma, Tagata, all of Japan

[73] Assignee: Toyo Metallizing Co., Ltd., Tokyo, Japan

[21] Appl. No.: 163,656

[22] Filed: Dec. 7, 1993

Related U.S. Application Data

[60] Continuation of Ser. No. 863,424, Apr. 3, 1992, abandoned, which is a division of Ser. No. 441,020, Nov. 24, 1989, abandoned.

[30] Foreign Application Priority Data

Nov. 24, 1988 [JP] Japan ..... 63-296992

[51] Int. Cl.[6] ..... H05B 6/80

[52] U.S. Cl. ..... 219/730; 219/725; 99/DIG. 14; 426/107; 426/113; 426/234; 426/243; 428/323

[58] Field of Search ..... 219/730, 731, 725; 99/DIG. 14; 426/107, 113, 234, 243; 428/323, 408, 414; 427/106

[56] References Cited

U.S. PATENT DOCUMENTS

| | | | |
|---|---|---|---|
| 2,582,174 | 1/1952 | Spencer | 426/243 |
| 3,853,612 | 12/1974 | Spanoudis | 427/106 |
| 4,144,438 | 3/1979 | Gelman et al. | 219/728 |
| 4,190,757 | 2/1980 | Turpin et al. | 219/730 |
| 4,230,924 | 10/1980 | Brastad et al. | 219/730 |
| 4,267,420 | 5/1981 | Brastad | 219/730 |
| 4,364,995 | 12/1982 | Crawford et al. | 428/336 |
| 4,883,936 | 11/1989 | Maynard et al. | 219/759 |
| 4,933,193 | 6/1990 | Fisher | 426/107 |
| 4,943,439 | 7/1990 | Andreas et al. | 426/107 |
| 4,943,456 | 7/1990 | Pollart et al. | 219/730 |
| 4,962,000 | 10/1990 | Emslander et al. | 219/730 |
| 4,970,358 | 11/1990 | Brandberg et al. | 219/759 |
| 5,006,405 | 4/1991 | Watkins et al. | 428/323 |

FOREIGN PATENT DOCUMENTS

| | | |
|---|---|---|
| 50-29157 | 8/1975 | Japan . |
| 60-15548 | 4/1985 | Japan . |
| 60-262960 | 12/1985 | Japan . |

*Primary Examiner*—Bruce A. Reynolds
*Assistant Examiner*—Tu Hoang
*Attorney, Agent, or Firm*—Scully, Scott, Murphy & Murphy

[57] ABSTRACT

A composite material suitable for use as a microwave heating wrapper, comprising a base and an electroconductive layer formed on at least one side of the base, the electroconductive layer being a mixed layer of at least one metal and at least one metal oxide.

11 Claims, No Drawings

COMPOSITE MATERIAL FOR MICROWAVE HEATING

This is a continuation of application Ser. No. 863,424, filed on Apr. 3, 1992, which is a divisional of Ser. No. 441,020, filed on Nov. 24, 1989, both now abandoned.

BACKGROUND OF THE INVENTION

The present invention relates to a composite material for use as a microwave (hereinafter referred to simply as "M-W") heating wrapper.

PRIOR ART

The method of thawing and heat-cooking various foods using a microwave oven which utilizes a heating principle with microwave has recently become popular because it can be easily carried out in a short time. With improvement and development of microwave ovens as electric devices and that of foods for microwave ovens, the cooking method in question will become more and more popular while adapting itself to and being accepted by the recent mode of life. Cooking with a microwave oven is quick and easy, but it is the greatest problem that the surface of cooked food is not browned. In the case of a food whose greatest feature resides in a crispy tooth feel (so-called crispness), e.g. pizza crust, the steam generated therefrom may be deposited again on the surface of the pizza crust, resulting in that the crispness thereof is impaired and so the value thereof as a commodity is markedly deteriorated. Whether there is browning or not has a great influence on the sense of sight for cooked food. Besides, browning means that the surface moisture can be removed, thus serving as a useful means for the development of the foregoing crispness.

Heretofore, as a method for browning the food surface during cooking in a microwave oven, there has been known a method which utilizes a vapor-deposited film of an electroconductive metal such as aluminum, for example from U.S. Pat. Nos. 3,853,612 and 2,582,174. According to this method, a thin film of an electroconductive metal generates an eddy curent under the action of M-W and the resulting heating action is utilized. In this case, if the vapor-deposited layer is thick, a large current will flow and cause a spark, which results in breakage of the vapor-deposited film or disconnection.

In order to obtain a sufficient quantity of heat it is desirable that the electroconductive metal layer be thick. However, for avoiding the aforementioned sparking, it has been proposed, for example, in Japanese Patent Publication No. 15548/1985 to perform vapor deposition so that there is obtained a film having a thickness which is one-tenth to one to several hundreds of the film thickness obtained in the ordinary vapor deposition. Moreover, a method in which a vapor-deposited layer forming base is placed outside and vapor-deposited metal layer placed inside so that M-W may not be applied directly to the metal layer, as a restriction in construction, and a method in which the metal deposition surface is subdivided in a lattice form, are proposed in U.S. Pat. No. 4,230,924 and Japanese Patent Laid-Open No. 262960/1985.

In the case of using a vapor-deposited metal film as an M-W heating wrapper on the basis of the principle that an electroconductive metal film generates an eddy current under the action of M-W and further generates so-called Joule heat which can be expressed by Ecc $I^2R$ (E: quantity of heat, I: current, R: resistance), it is inevitably required in the prior art, for preventing the foregoing spark, to thin a vapor-deposited metal layer which already has a sufficiently small thickness or subdivide the vapor-deposited metal surface to decrease the inducted current value. As a result, the quantity of heat generated is inevitably decreased and the function of browning the food surface is not fully exhibited, with only slight browning imparted to the surface.

It is the object of the present invention to provide an M-W heating wrapper free of the above-mentioned drawbacks, capable of generating heat sufficient to brown the surface of being cooked using M-W in a microwave oven and capable of preventing spark even when vapor-deposited metal surface is exposed directly to M-W.

SUMMARY OF THE INVENTION

The above-mentioned object of the present invention can be achieved by an M-W heating wrapper characterized in that an electroconductive layer formed by a mixture of at least one metal and at least one metal oxide is provided on at least one side of a base.

As to the electroconductive layer provided on the base, it is necessary that at least one metal and at least one metal oxide be mixed together therein. Examples of employable metals and metal oxides include such metals as aluminum, tin, zinc, lead, iron and copper, and oxides thereof. A combined use of aluminum and a aluminum oxide is most suitable.

The aluminum to be used is one commonly used for vapor deposition and having a purity of 90 to 99.99%. No problem arises even if it contains about 10 wt % or less of such metals as copper, iron, tungsten and molybdenum as well as zirconium oxide, boron nitride, magnesium oxide, titanium oxide and tungsten oxide. Examples of aluminum oxide include AlO, $Al_2O_2$ and $Al_2O_3$, with $Al_2O_3$ being preferred in point of stability. Both crystalline and amorphous aluminum oxides are employable, but when viewed from the standpoint of cracking upon pulling or bending, the amorphous one is preferred.

In the case where the electroconductive layer is a mixed layer of aluminum and aluminum oxide, it is preferable that the aluminum oxide/metal aluminum weight ratio be in the range of $\frac{1}{4}$ to 9/1. If this ratio is lower than $\frac{1}{4}$, there will occur a spark upon radiation of M-W, while if it exceeds 9/1, the quantity of heat generated will be decreased. In this case, other metals than aluminum such as, for example, tin, zinc, lead, iron and copper may be present in an amount not larger than 50 wt %, and other metal oxides than aluminum oxide such as, for example, oxides of tin, zinc, lead, iron and copper may be present in an amount not larger than 50 wt %.

As the method for forming the mixed electroconductive metal-metal oxide layer on the base, there can be adopted any of, for example, a so-called multiple vapor deposition method in which powders or moldings such as pellets of a metal and a metal oxide respectively in predetermined amounts are fed to different crucibles or boards and subjected to vapor deposition at a time; a method in which targets plates for the said materials are provided separately in the same vacuum vessel and subjected to sputtering at a time; and a reactive vapor deposition method in which the materials in question are melted and evaporated by metal resistance heating, induction heating or electron beam heating, while at the same time oxygen gas is introduced under a certain control, allowing a desired proportion of the metal to undergo an oxidation reaction, and thus a mixed metal-metal oxide vapor-deposited layer is formed in a single step.

The base for the electroconductive layer formed by a mixture of at least one metal and at least one metal oxide is not specially limited if only it permits vapor deposition of metals thereon. It may be selected according to the amount of heat to be Generated. Typical examples include film and sheets formed by polyolefins such as polyethylene and polypropylene, polyesters such as polyethylene terephthalate, polybutylene terephtalate and polybutylene-2, 6-naphthalate, polyamides such as 6-nylon and 12-nylon, aromatic polyamides, polyimides, and copolyers of these polymers with other organic polymers. Various additives, including antistatic agent, plasticizer, lubricant and pigment, may be incorporated in those polymers and copolymers. Even other than these plastic films and sheets there may be used, for example, papers and non-woven fabrics if only these possess properties suitable as the base for metal vapor deposition. Further, laminates of plural materials exemplified above may be used according to purposes. The base may be transparent or opaque, or may be printed if necessary.

The thickness of the base is not specially limited. But from the standpoint that the wrapper of the invention is to be used as a heating material in a microwave oven it is preferable for the base to have a thickness of 3 to 500 μm, while from the standpoint of mechanical strength and flexibility the thickness of the base is more preferably in the range of 6 to 200 μm.

When there is used practically the M-W heating wrapper of the present invention comprising the base and the mixed electroconductive metal-metal oxide layer formed on at least one side of the base, it may be laminated to another plastic film or sheet in order to improve the so-called handleability such as stiffness. Moreover, the heating wrapper of the invention may be in the form of a sheet for contact with the upper and lower surfaces of food, or a shape capable of wrapping the whole of food therein, or a molded shape such as a tray. In this case, no restriction is placed on the position of the electroconductive layer, which layer may be the outermost layer to be exposed directly to M-W. In this connection, the electroconductive layer may be subjected to a mold releasing treatment to prevent scorching of the surface in contact with food.

The temperature of the heat generated upon radiation of M-W to the M-W wrapper of the present invention may be set optionally. Where a polyester film is used as the base, it is possible to obtain the temperature of 260° C. (corresponding to the melting point of the film. When there is used a film not having a melting point such as a polyimide film or an aromatic polyamide film as the base film, it is possible to obtain the heat temperature generated of 300° C.

In the electroconductive layer of the M-W heating wrapper according to the present invention, since the electroconductive metal element and the metal oxide as a non-electroconductive substance are discontinuous as a whole though both are partially continuous, it is possible to obtain large current and resistance values which are necessary for the generation of Joule heat. Therefore, the heat necessary and sufficient to impart browning to food can be generated in an extremely short time cooking in a microwave oven.

Moreover, since the electroconductive layer does not cause sparking even upon direct radiation of M-W thereto, there is no restriction on the structure as an M-W heating wrapper. Further, unlike a mere vapor-deposited thin film the entire film thickness of the M-W heating wrapper of the present invention can be set to 500 Å or so which is the most easily controllable thickness industrially, thus permitting stable production.

The present invention will be described below in detail in terms of working examples thereof, in which characteristic values were determined by the following methods.

a. Composition of the Electroconductive Layer $Al_{2P}$ spectrum of the surface of the vapor-deposited layer (electroconductive layer) was measured using ESCALAB 5 type (a product of VG SCIENTIFIC Limited) according to an X-ray photoelectron spectroanalysis (ESCA), and the aluminum/aluminum oxide composition ratio was calculated from an integral intensity of peaks corresponding to bond energy.

b. Temperature of Heat Generated

The vapor-deposited metal layer (electroconductive layer) was placed up and the film surface as a sticking surface was affixed to paper weighing about 50 g/m$^2$, then heat labels type A to J manufactured by MICRON K.K. were affixed directly to the vapor-deposited surface, or a glass schale with the heat labels affixed thereto was put on the surface of the vapor-deposited layer, then an M-W treatment was performed using a microwave oven type ER-630SF (a product of Toshiba Corporation), and the temperature of heat generated was measure at every predetermined time.

c. Light Ray Transmissivity

Light ray transmissivity of the M-W heating wrapper was determined using an automatic recording spectrophotometer type 330 (a product of Hitachi, Ltd.).

Example I

Electroconductive layers having different aluminum-/aluminum oxide ratios were each formed by vapor deposition on a biaxially oriented polyethylene terephthalate base film having a thickness of 12 μm to prepare M-W heating wrappers. The results of measurements and evaluation are as shown in Table 1.

In Example 1 described in Table 1, the generation of heat by M-W radiation reached equilibrium at approximately 130° C. because of a high proportion of aluminum oxide in the vapor-deposited film (there was no sparking).

In Example 2, the temperature of heat generated in 150 seconds was 210° C. because of a high proportion of aluminum although the film thickness was the same as in Example 1. In Example 4 wherein the proportion of aluminum was further increased, the temperature of heat generated in 150 seconds was found to be 230° C. without spark. In Example 3 wherein the entire film thickness was increased although the film composition was the same as in Example 2, the temperature of heat generated in 150 seconds was found to be 260° C. without spark.

On the other hand, Comparative Example 1 to 4 are for making the effect of the present invention clear, and none of them could achieve the object of the present invention. More particularly, in Comparative Example 1 using an ordinary vapor-deposited aluminum film 400

Å thick formed of aluminum alone, there occurred sparking almost simultaneously with M-W radiation and the film was broken. In Comparative Example 2 using a merely thinned vapor-deposited aluminum film, the heat-up rate was low and the temperature of heat generated in 150 seconds was 200° C. although there was no sparking. Further, in Comparative Example 3 using a vapor-deposited film of tin alone and in Comparative Example 4 using a vapor-deposited film of zinc alone there occurred sparking almost simultaneously with M-W radiation and the film was broken.

Example II

As electroconductive layer of a 50/50 wt % mixture of aluminum and aluminum .oxide was formed by vacuum deposition on each of a polyphenylene sulfate base film (m.P. 285° C., a product of Toray Industries Inc.) and an aromatic film to prepared M-W heating wrappers. The result of measurements and evaluation are as shown in Table 1. (In Examples 5 and 6 both described in Table 1 there were used the polyphenylene sulfate base film and the aromatic polyamide base film, respectively.)

The temperature of heat generated in 150 seconds after M-W radiation in Example 5 and that in Example 6 were found to be 283° C. and 300° C., respectively. No sparking was observed in both Examples.

TABLE 1

| | Characteristics | | | | | | | |
|---|---|---|---|---|---|---|---|---|
| | Composition of vapor deposited | Thickness of Vapor deposited | light Transmit- | Surface Resistance | Temperature of Heat generated | | | |
| Sample | layer (wt %) | layer (A) | tance (%) | (Ω) | after 60 sec | after 100 sec | after 150 sec | Spark |
| Example. 1 | $Al/Al_2O_3$ (10/90) | 400 | 65 | more than 2000 | — | 110 | 130 | non |
| Example. 2 | $Al/Al_2O_3$ (50/50) | 400 | 58 | 900 | 200 | 205 | 210 | non |
| Example. 3 | $Al/Al_2O_3$ (50/50) | 650 | 51 | 700 | 210 | 250 | 260 | non |
| Example. 4 | $Al/Al_2O_3$ (80/20) | 400 | 10 | 100 | 190 | 220 | 230 | non |
| Com, Example. 1 | $Al/Al_2O_3$ (100/0) | 400 | 1 | 2 | non | non | non | non |
| Com, Example. 2 | $Al/Al_2O_3$ (100/0) | 5–10 | 60 | 70 | 100 | 180 | 200 | non |
| Com, Example. 3 | Sn (100) | 420 | 1 | 2 | non | non | non | emitted |
| Com, Example. 4 | Zn (100) | 380 | 1 | 3 | non | non | non | emitted |
| Example. 5 | $Al/Al_2O_3$ (50/50) | 600 | 50 | 650 | 190 | 260 | 283 | non |
| Example. 6 | $Al/Al_2O_3$ (50/50) | 550 | 52 | 700 | 200 | 270 | 300 | non |

As is apparent from the above results, the M-W heating vapor-deposited films according to the present invention emit no spark and can afford large quantities of heat rapidly as compared with the thin vapor-deposited films each of a single metal not containing aluminum oxide. Using the M-W heating films of the above working examples, pizza ("Pizza & Pizza" for oven, a product of Meiji Seika Kaisha Ltd.) was cooked for about 4 minutes (including a thawing time) in the foregoing microwave oven, and hot cake mix (for frying-pan, a product of Morinaga Confectionery co., Ltd.) was also cooked for about 4 minutes in the same manner. Upon completion of the cooking, those foods were clearly browned on the respective surfaces and were found to have a good flavor rich in crispness.

In the M-W heating wrapper of the present invention, as set forth above, an electroconductive layer of a metal-metal oxide mixture is formed on a base such as film by vapor deposition, so the use thereof in a microwave oven permits a rapid generation of heat in a quantity suitable for the food being cooked and can impart browning and good flavor such as crispness to the food.

What is claimed is:

1. A method of heating a substance in a microwave oven comprising the steps of:

a) contacting said substance to be heated in a composite material wrapper, said composite material wrapper comprising a base material and a non-sparking, reactive vapor-deposited electroconductive layer, wherein said non-sparking, reactive vapor-deposited electroconductive layer is present on at least one side of said base material and is composed of at least one metal and at least one metal oxide, and further wherein said layer has a thickness having a ratio of said metal to said metal oxide which is not increasing or decreasing through the thickness, said ratio being selected whereby said composite material wrapper does not spark upon being radiated with microwave radiation; and b) subjecting said substance and composite material wrapper to microwave energy to heat said substance.

2. The method of claim 1, wherein said non-sparking, reactive vapor-deposited electroconductive layer is provided by melting said at least one metal and said at least one metal oxide and simultaneously evaporating said at least one metal and said at least one metal oxide in the presence of oxygen gas to permit a portion of said at least one metal to undergo an oxidation reaction to provide said layer composed of at least one metal and at least one metal oxide.

3. The method as claimed in claim 1, wherein said metal is aluminum and said metal oxide is aluminum oxide.

4. The method as claimed in claim 3, wherein the aluminum oxide to aluminum weight ratio is in the range of $\frac{1}{4}$ to 9/1.

5. The method as claimed in claim 1, wherein said base material is a film or sheet of an organic polymer.

6. The method as claimed in claim 1, which is for imparting browning to food being cooked in a microwave oven.

7. The method of claim 1, wherein said metal is tin, zinc, lead, iron or copper and wherein said metal oxide is an oxide of tin, zinc, lead, iron or copper, said metal being present in an amount not larger than 50% and said metal oxide being present in an amount not larger than 50%.

8. A method for browning foods in a microwave oven including the steps of:

a) contacting an article to be browned with a composite composed of a base layer and a single, reactive-vapor-deposited electroconductive layer of a mixture of at least one metal and at least one metal oxide, said electroconductive layer having a thickness of about 400 Å to about 650 Å; and b) subjecting said article and composite to microwave energy to brown and heat said article, respectively.

9. The method as claimed in claim 8, wherein said thickness is about 500 Å.

10. The method as claimed in claim 8, wherein the metal and metal oxide are aluminum and aluminum oxide, respectively.

11. The method as claimed in claim 8, wherein said single, reactive-vapor-deposited electroconductive layer of a mixture of at least one metal and at least one metal oxide is provided by:

(a) melting said at least one metal and said at least one metal oxide to form said mixture; and (b) simultaneously evaporating said mixture in the presence of oxygen gas to permit a portion of said at least one metal to undergo an oxidation reaction.

* * * * *